US005131337A

United States Patent [19]

Wang

[11] Patent Number: 5,131,337

[45] Date of Patent: Jul. 21, 1992

[54] PRESSER OF A SEWING MACHINE

[76] Inventor: Shui-Nu Wang, No. 6, Nan Pin Road, Taichung,, Taiwan

[21] Appl. No.: 729,061

[22] Filed: Jul. 15, 1991

[51] Int. Cl.[5] ..... D05B 29/08; D05B 29/10

[52] U.S. Cl. ..... 112/152; 112/235

[58] Field of Search ..... 112/235, 240, 152, 148, 112/320, 322, 50, 60

[56] References Cited

U.S. PATENT DOCUMENTS

| | | | |
|---|---|---|---|
| 202,303 | 4/1878 | Trowbridge | 112/235 X |
| 321,304 | 6/1885 | Lancaster | 112/235 |
| 843,440 | 2/1907 | Burrage | 112/235 X |
| 1,597,883 | 8/1926 | Hake | 112/235 X |
| 2,627,240 | 2/1953 | Johnson et al. | 112/235 |
| 5,054,407 | 10/1991 | Rowley | 112/235 |

*Primary Examiner*—Werner H. Schroeder
*Assistant Examiner*—Paul C. Lewis

[57] ABSTRACT

A presser of a sewing machine including a body movable downward for pressing an elastic band to be sewed, a roller rotatably disposed in one end of the body, a member having one end pivotally supported on a middle portion of the body and having a tapered surface formed in the bottom of the other end, a spring and a bolt engaged through the middle portion of the member for biasing the tapered surface downward against the roller, the elastic band being resiliently grasped between the tapered surface and the roller so that the elastic band can be stretched.

10 Claims, 3 Drawing Sheets

PRESSER OF A SEWING MACHINE

BACKGROUND OF THE INVENTION

1. Field of the Invention

The present invention relates to a presser, and more particularly to a presser of a sewing machine.

2. Description of the Prior Art

A typical presser of a sewing machine is movable downward and is provided for pressing the cloth to be sewed during sewing operations. When an elastic band to be sewed is pressed by the conventional presser, the user has to extend or to stretch the elastic band manually by his two hands during sewing operations so that the elastic band can be sewed. This is very inconvenient.

The present invention has arisen to mitigate and/or obviate the afore-described disadvantages of the conventional pressers of the sewing machine.

SUMMARY OF THE INVENTION

The primary objective of the present invention is to provide a presser of a sewing machine in which the elastic band can be sewed easily and need not be stretched manually during sewing operations.

In accordance with one aspect of the present invention, there is provided a presser of a sewing machine including a body movable downward for pressing an elastic band to be sewed, the body including an opening formed in a first end thereof, a roller rotatably disposed in the opening of the body, a member having one end pivotally supported on a middle portion of the body, and having a tapered surface formed in the bottom of the other end, a bolt extended through a middle portion of the member and threadedly engaged to the body, and a spring biased between the bolt and the member for biasing the member downward and arranged such that the tapered surface can be pressed against the roller, the elastic band being inserted through the space between the tapered surface of the member and the roller and can be resiliently grasped therebetween, and through the opening toward a lower surface of the body so that a portion of the elastic band can be stretched.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
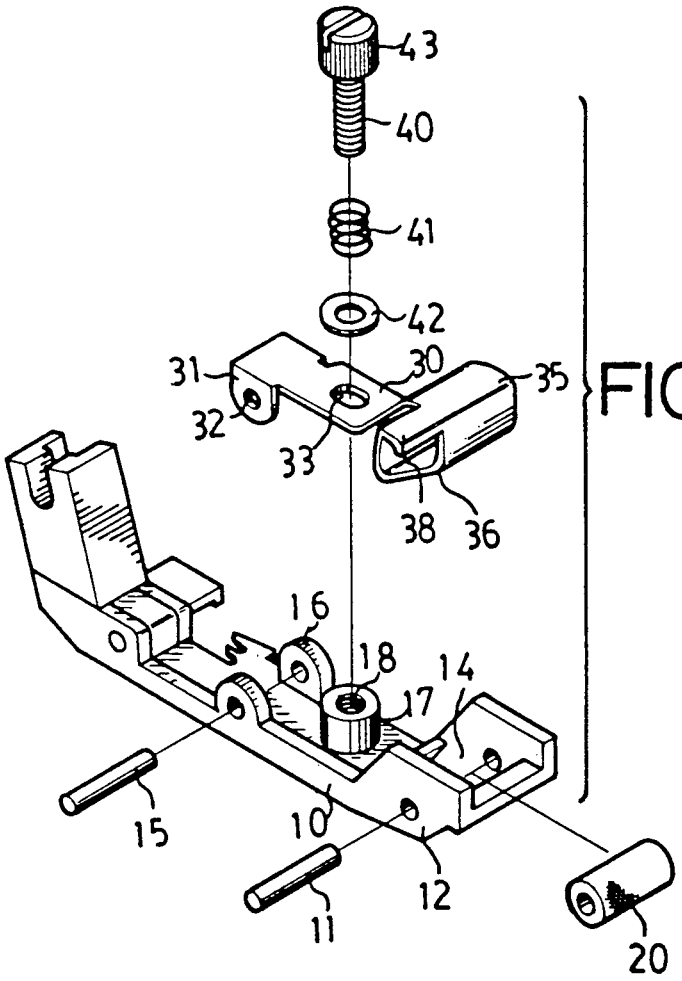
FIG. 1 is an exploded view of a presser in accordance with the present invention.
Figure 2:
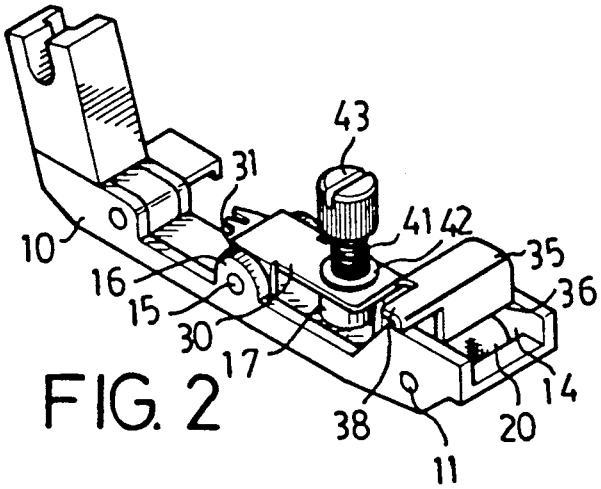
FIG. 2 is a perspective view of the presser.
Figure 3:
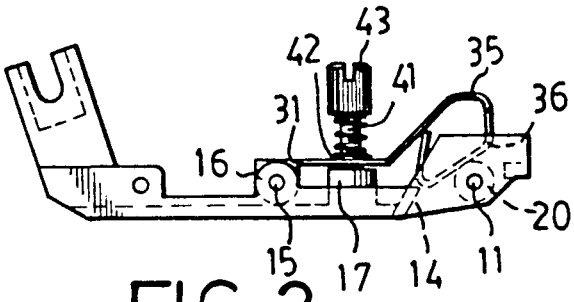
FIG. 3 is a side view of the presser.

Referring to the drawings and initially to FIGS. 1, 2 and 3, the presser in accordance with the present invention comprises generally a body 10 movable downward for pressing the cloth, especially the elastic band to be sewed during sewing operations; a roller 20, such as a friction roller, rotatably supported on one end of the body 10; and a member 30 engageable on the body 10. The elastic band 50 (FIGS. 5 and 6) to be sewed can be frictionally clamped between the member 30 and the roller 20 during sewing operations so that the portion of the elastic band 50 located between the bottom of the body 10 and the roller 20 can be stretched.

A rod 11 is disposed in the first end 12 of the body 10 where an opening 14 is formed. The friction roller 20 is rotatably supported on the rod 11. A shaft 15 is supported by a pair of lugs 16 which are formed on the middle portion of the body 10. A boss 17 is formed on the body 10 and located between the lugs 16 and the roller 20, and has a screw hole 18 formed therein.

Figure 4:
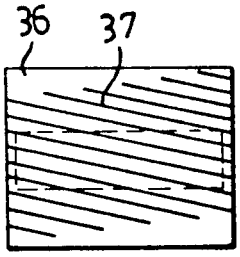
FIG. 4 is a plane view of a lower surface of a member.

The member 30 includes a pair of ears 31 extended downward from a first end thereof, each of the ears 31 has a hole 32 formed therein for rotatable engagement on the shaft 15 so that the member 30 is rotatable about the shaft 15. A head 35 is formed on the second end of the member 30 and is preferably folded from a strip or the like to form a loop and includes a tapered surface 36 formed in the bottom thereof. The member 30 has an oblong hole 33 formed in the middle portion thereof, through which a bolt 40 is engaged with the screw hole 18 of the boss 17. A spring 41 and a washer 42 are disposed between the head 43 of the bolt 40 and the upper surface of the member 30 so that the member 30 can be resiliently pressed downward toward the body 10 by the spring 41 and so that the tapered surface 36 of the head 35 can be resiliently pressed against the roller 20. As shown in FIG. 4, the tapered surface 36 of the head 35 is suitably embossed with a plurality of lines 37 which are parallel with one another.

A handle portion 38 is extended from the head 35 so that the head 35 of the member 30 can be lifted upward away from the roller 20 and so that the elastic band 50 can be inserted through between the tapered surface 36 of the head 35 and the roller 20.

Figure 5:
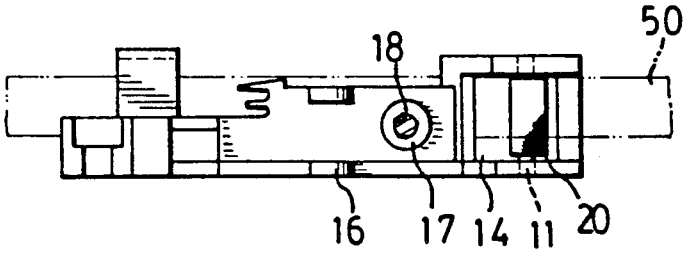
FIG. 5 is a top view of the body, in which an elastic band is pressed by the presser.
Figure 6:
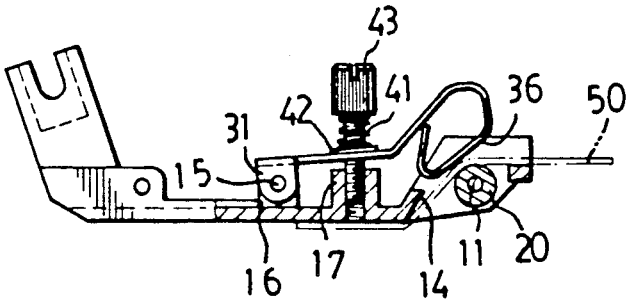
FIG. 6 is a side view of the presser as shown in FIG. 5.

Referring next to FIGS. 5 and 6, in use, the elastic band 50 can be inserted between the tapered surface 36 of the head 35 and the roller 20, and then inserted through the opening 14 toward the lower surface of the body 10. Since the head 35 is resiliently pressed downward toward the roller 20, the elastic band 50 can be frictionally grasped between the tapered surface 36 of the head 35 and the roller 20, so that, during sewing operations, the portion of the elastic band located within the opening 14 and located between the lower surface of the body 10 and the roller 20 can be stretched. Whereby, the elastic band 50 can be easily sewed and need not to be stretched manually by the hands of the user. It is to be noted that the direction of the embossed lines 37 of the tapered surface 36 is arranged such that the elastic band 50 can be caused to move toward one side of the body 10.

Figure 7:
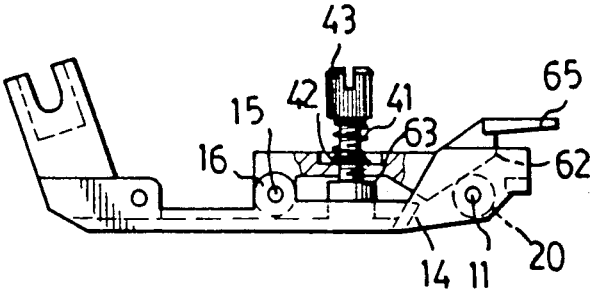
FIG. 7 is a side view of a presser in accordance with another embodiment of the present invention.
Figure 8:
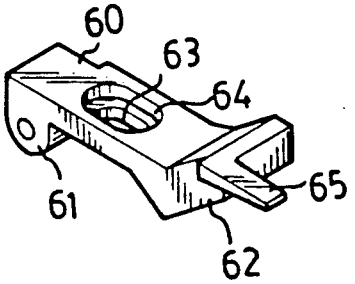
FIG. 8 is a perspective view illustrating an alternative member.

Alternatively, as shown in FIGS. 7 and 8, the member 60 includes an extension 61 extended downward from the first end thereof for rotatably engaged on the shaft 15 of the body 10; and a tapered surface 62 formed on the second end thereof. An oblong hole 63 is formed in the middle portion of the member 60 so that the bolt 40 can be engaged therethrough. A recess 64 is formed above the oblong hole 63 for receiving the washer 42 and the lower portion of the spring 41. The tapered surface 62 is resiliently pressed against the roller 20 by the spring 41. A handle portion 65 is formed on the second end of the member 60 so that the second end of the member 60 can be lifted upward away from the roller 20 and so that the elastic band can be inserted through between the tapered surface 62 and the roller 20.

Accordingly, the elastic band to be sewed can be stretched by the presser in accordance with the present invention so that the elastic band can be easily sewed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A presser of a sewing machine comprising a body movable downward for pressing an elastic band to be sewed, said body including an opening formed in a first end thereof; a roller rotatably disposed in said opening of said body; a member including a first end pivotally supported on a middle portion of said body, and a second end having a tapered surface formed in a bottom portion thereof; a bolt extended through a middle portion of said member and threadedly engaged to said body; and a spring biased between said bolt and said member for biasing said member downward and arranged such that said tapered surface is pressed against said roller; said elastic band being resiliently grasped between said tapered surface of said member and said roller.

2. A presser according to claim 1, wherein a shaft is disposed on said middle portion of said body, said first end of said member is rotatably engaged on said shaft.

3. A presser according to claim 2, wherein said member includes a pair of ears extended downward from said first end thereof for engagement on said shaft.

4. A presser according to claim 2, wherein said member includes an extension extended downward from said first end thereof for engagement on said shaft.

5. A presser according to claim 1, wherein said member includes a head formed on said second end thereof, said tapered surface is formed on a bottom of said head.

6. A presser according to claim 5, wherein said tapered surface is formed with an embossment.

7. A presser according to claim 6, wherein said embossment includes a plurality of lines formed in parallel with one another.

8. A presser according to claim 1, wherein a handle portion is formed on said second end of said member for pulling said second end of said member away from said roller enabling said elastic band to be inserted through and between said tapered surface and said roller.

9. A presser according to claim 1, wherein a boss is integrally formed on said body and has a screw hole formed therein, said bolt is threadedly engaged with said screw hole of said boss.

10. A presser according to claim 9, wherein an oblong hole is formed in said middle portion of said member, said bolt extends through said oblong hole and is threadedly engaged with said screw hole of said boss, and said spring is biased between said bolt and an upper surface of said member.

* * * * *